US010591183B2

(12) United States Patent
Clark

(10) Patent No.: US 10,591,183 B2
(45) Date of Patent: Mar. 17, 2020

(54) UNPRESSURIZED HORIZONTAL ELECTRIC STORAGE TANK WATER HEATER

(71) Applicant: Bruce Edward Clark, Madison, ME (US)

(72) Inventor: Bruce Edward Clark, Madison, ME (US)

( * ) Notice: Subject to any disclaimer, the term of this patent is extended or adjusted under 35 U.S.C. 154(b) by 246 days.

(21) Appl. No.: 15/876,169

(22) Filed: Jan. 21, 2018

(65) Prior Publication Data

US 2019/0226718 A1 Jul. 25, 2019

(51) Int. Cl.

| | |
|---|---|
| ***F24H 1/18*** | (2006.01) |
| ***F24H 9/12*** | (2006.01) |
| ***F24H 9/00*** | (2006.01) |
| ***F24H 1/20*** | (2006.01) |

(52) U.S. Cl.

CPC ..... *F24H 1/182* (2013.01); *F24H 1/185* (2013.01); *F24H 1/201* (2013.01); *F24H 9/0042* (2013.01); *F24H 9/126* (2013.01)

(58) Field of Classification Search

CPC ..... F24H 1/182; F24H 1/185; F24H 1/201; F24H 9/0042; F24H 9/126; F24H 1/122; F24H 1/125; F24H 1/128; F24H 1/181; F24H 3/004; F24H 4/02; F24H 7/0233; F24H 7/0266; F24H 7/0291; F24H 7/0433; F24H 7/0466; F24H 7/0491; F24H 9/0021

USPC .... 392/451, 322, 458, 444; 122/13.01, 19.1, 122/19.2; 126/373.1, 375.1, 378.1

See application file for complete search history.

(56) References Cited

U.S. PATENT DOCUMENTS

| | | | | | |
|---|---|---|---|---|---|
| 2,452,933 | A * | 11/1948 | Joppich | A47J 31/401 | 222/145.6 |
| 2,673,920 | A * | 3/1954 | Donovan | A47J 31/542 | 392/484 |
| 4,032,748 | A * | 6/1977 | Vischer | A47J 31/542 | 392/396 |
| 4,641,012 | A * | 2/1987 | Roberts | A47J 31/007 | 219/513 |
| 4,809,594 | A * | 3/1989 | Vitous | A47J 31/002 | 426/433 |
| 5,551,331 | A * | 9/1996 | Pfeifer | A47J 31/36 | 99/280 |
| 5,678,734 | A * | 10/1997 | Walker | A47J 31/54 | 222/109 |
| 5,816,199 | A * | 10/1998 | Khizh | F24H 1/186 | 122/367.1 |

(Continued)

FOREIGN PATENT DOCUMENTS

| | | | | |
|---|---|---|---|---|
| WO | WO-2012098763 A1 * | 7/2012 | ..... | F24H 1/182 |

*Primary Examiner* — Justin M Jonaitis

(57) ABSTRACT

The invention provides for protection of life safety, property and the liability thereof, by means of a intrinsically safe unpressurized storage tank water heater while producing hot pressurized water. The design addresses, with effect, convection, radiation, conduction and evaporative heat energy losses. Heat lost returned as usable hot water resulting in ultra-low standing loss. The stationary water medium prevents sedimentation, fouling of the heating element and gases expelled. Being dielectrically isolated, the medium may also be treated to further reduce corrosion. The design allows for a quick recovery rate and provides adjustable volume of hot water, being stackable, stage able, renewable, repairable and recyclable.

6 Claims, 12 Drawing Sheets

(56) References Cited

U.S. PATENT DOCUMENTS

Figure 1:
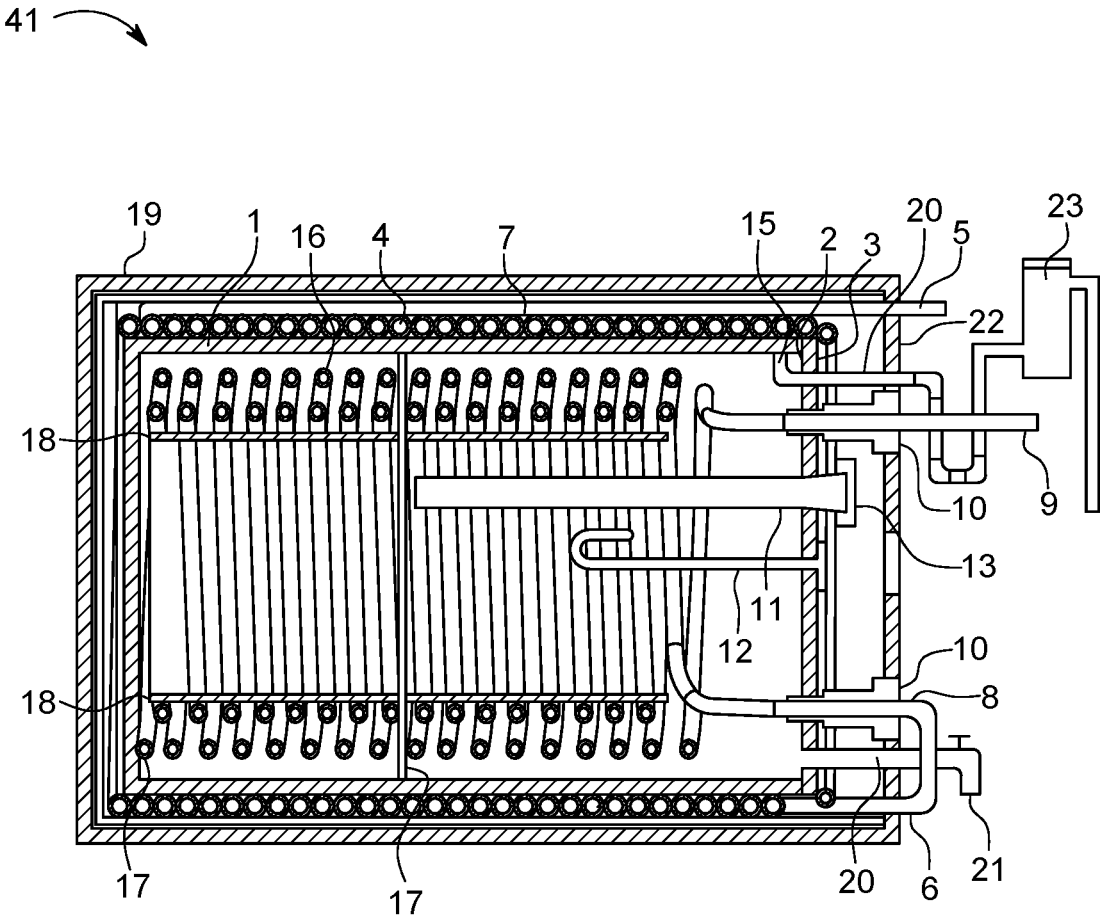

| | | | | |
|---|---|---|---|---|
| 6,198,879 | B1 * | 3/2001 | Harris | F24H 7/0433<br>392/451 |
| 2011/0256289 | A1 * | 10/2011 | Steiner | A47J 31/4485<br>426/523 |

* cited by examiner

UNPRESSURIZED HORIZONTAL ELECTRIC STORAGE TANK WATER HEATER

BACKGROUND OF INVENTION

A new class of storage tank water heater not yet named. A horizontal unpressurized water vessel that must bear the weight of the water and the temperatures employed that communicates with the atmosphere. Said vessel takes its pressurized water from a heat exchange coil via water medium, conventionally heated, built and insulated in a rectangular manner.

Technical Field

The present invention relates to electric resistance, storage tank water heaters.

Background of Related Art

The vertical pressurized electric water heater invented in the $19^{th}$ century has changed little. The potential for explosive forces to build up is dependent upon proper maintenance . The oxygen rich environment in conjunction with a temperature conducive to legionnaires and corrosion is the norm. A rupture results a sustained water leak until discovered.

The vertical tank has uncontrolled convection and radiant heat loss. The convection and kinetic forces of the incoming cold water causes channeling, controlled and uncontrolled mixing, all diluting usable hot water, rendering the, heater less efficient. The constant injection of raw water leads to sedimentation and heating element fouling.

As the temperature and pressure increase, condensed oxygen induces a high rate of corrosion, which in turn shortens device life span and causes the consumer to dispose of the heater. The vertical orientation also makes the vessel susceptible to earthquakes.

The conventional heater sized to meet the expected maximum demand by number of fixtures is inefficient; if sized to meet the number of people, it may become ineffective due to fluctuations in household size or family change necessitating replacement.

Numerous metal heat sinks and heat energy lost outside the tank make the heat energy unusable due to inefficiency.

Dissimilar metals set up a dielectric that causes galvanic corrosion at the cold inlet and hot outlet and the pressure temperature relief valve connections.

Built to the boiler pressure-vessel standard the conventional water heater is heavy resulting in, damage to property and lives in handling.

Built vertical access is required top and at least one side, round it fits no conventional space with efficacy.

Outline Of Advantages

To solve the aforementioned problems, the present invention has a unpressurized vessel, configured horizontally in a rectangular assembly. The benefits include reduced convective losses proportionally to height, the rectangular configuration allows 50% more insulation, a radiant barrier shell reflects heat back to the water and allows removal of the vessel from the insulation package for renewal or recycling.

The unpressurized vessel communicates with the atmosphere via a pressure/temperature vent assembly that allows gases and excess pressure to vent while maintaining water level and a gas re-entry seal, thus reducing corrosion. Since the hot potable water is separated from the volume of the vessel water medium, potential risk of Legionnaires disease is eliminated. A rupture damage of the vessel is limited to the volume of the vessel. The water medium is stationary, preventing sedimentation or fouling of the heating elements from occurring. The vessel is in a horizontal position, rendering it intrinsically earthquake proof.

A regenerative preheat coil wound exterior and directly upon the vessel wall and sized one pipe size larger, than supply to negate heat dissipation. This allows the water heater to store more usable hot water from heat energy otherwise lost.

Heat sinks are removed and replaced with C.P.V.C pipe stubs.

The design allows meeting household size with efficiency and effect by adjustable supply by means of a mixing valve and a rise in operating temperature. Thereby a user may change settings up to 45 gallon 1st hour draw. A second heater may be stacked on top of the first and a third for a maximum 135-gallon $1^{st}$ hour draw with a one-inch outlet.

The design eliminates dielectric galvanic corrosion by means of separation of contact of dissimilar metals with thermoplastic supports and sealing glands.

Built to water container standards it is lightweight, if dropped the internal vessel is not damaged and personal injury reduced.

Built horizontal and rectangular convenient installation under counter top and all other installation locations including exterior four seasons with wall access.

SUMMARY OF INVENTION

One embodiment of this invention provides for a electric fired unpressurized horizontal vessel that provides pressurized hot water comprising of: A 30 gallon open head drum with ring seal, open head closure, an external regenerative preheating coil, at least one internal heat exchange coil, three-bulkhead fitting, two sealing glands, an internal vent, an external vent that communicates with the atmosphere via a vent assembly, a radiant barrier shell, a rectangular insulation, a heating element and a thermostatic control device. By these means, the heater rendered intrinsically safe, more effective and efficient.

An embodiment of this, invention provides a unpressurized open head vessel that communicates with the atmosphere with a heat exchange coil, an electrical resistance heating element, a thermostatic control device and a water medium treated or untreated.

An embodiment of this invention, the pressure/temperature vent assembly provides a means to vent all gases and minimize evaporation while maintaining a positive water reservoir throughout the expansion and contraction cycles, sized to accommodate anticipated evaporation, while allowing over pressure direct communication with the atmosphere.

An embodiment of this invention provides for the repair and replacement of all parts by means of the radiant shell and the open head vessel with the sealing glands.

An embodiment of this invention provides an ability to store more energy by raising the temperature while employing a mixing device.

An embodiment of this invention provides a means of stacking and staging that replaces many different sizes, allows energy efficiency and efficacy in all instances.

An embodiment of this invention is the regenerative preheat coil that absorbs lost heat energy outside the vessel walls and returns it as usable hot water.

An embodiment of this invention provides for heat retention by reduction of metal heat sinks by way of CPVC stub pipes extending beyond the insulation jacket, eliminating the need of the pressure-temperature relief valve.

An embodiment of this invention provides for reduced maintenance by eliminating the temperature - pressure relief valve testing, replacing that with a visual inspection of the water level. Also sedimentation does not need flushing.

An embodiment of this invention provides for a light-weight vessel which saves in material and manufacturing cost, also reduces the possibilities of damage to property and persons in handling.

An embodiment of this invention provides for multiple installation locations being under counter tops, ceilings, attics, crawl spaces and exterior with wall access.

DRAWINGS

Figure 1A:
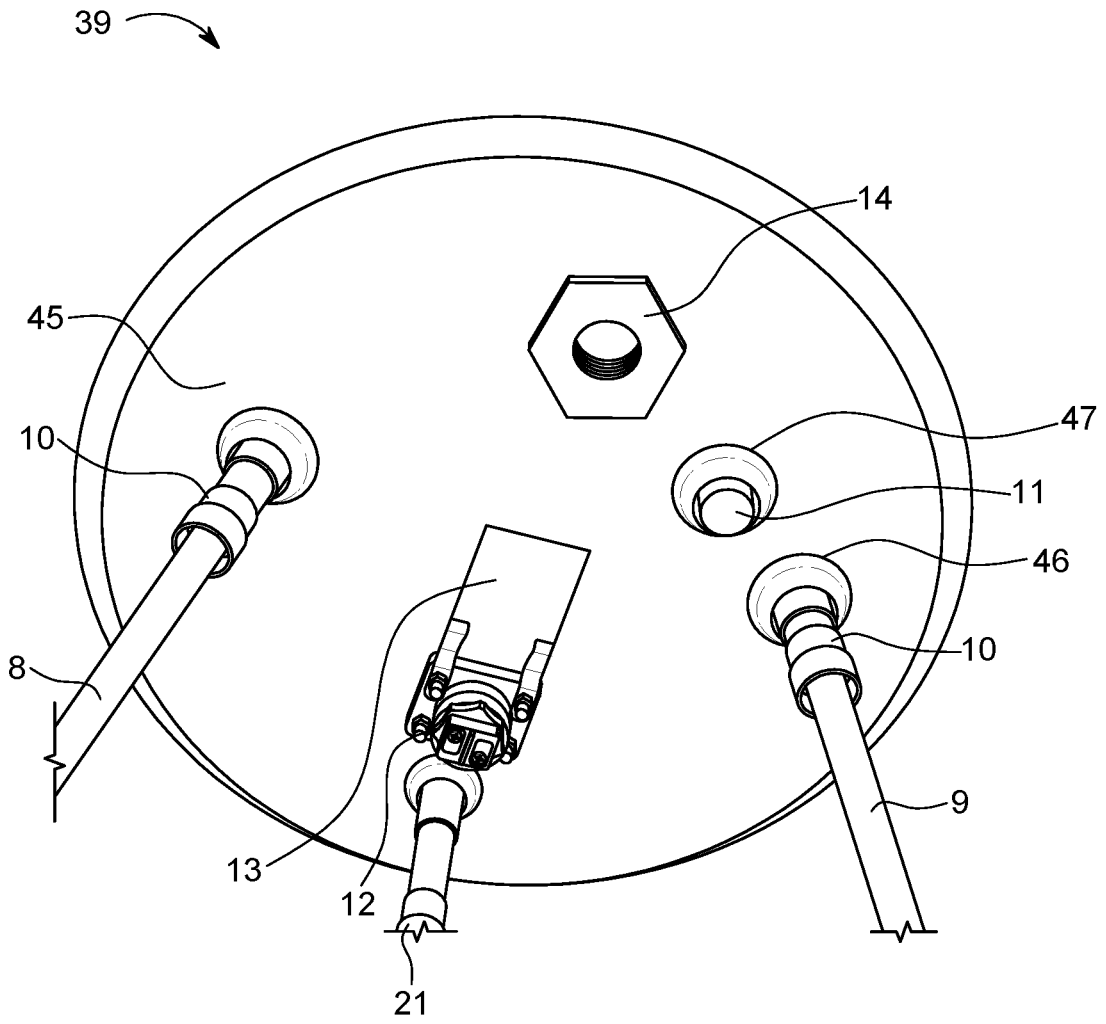
Figure 1B:
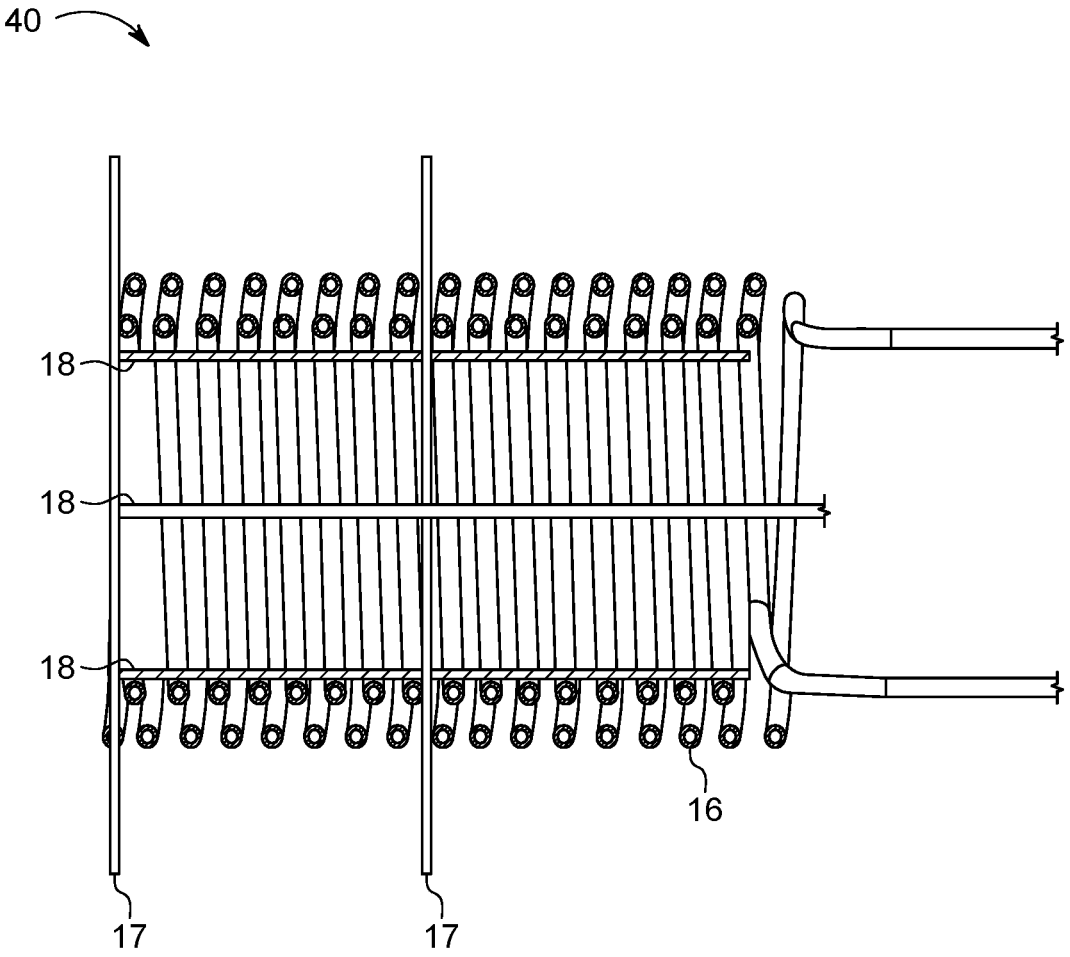
Figure 1C:
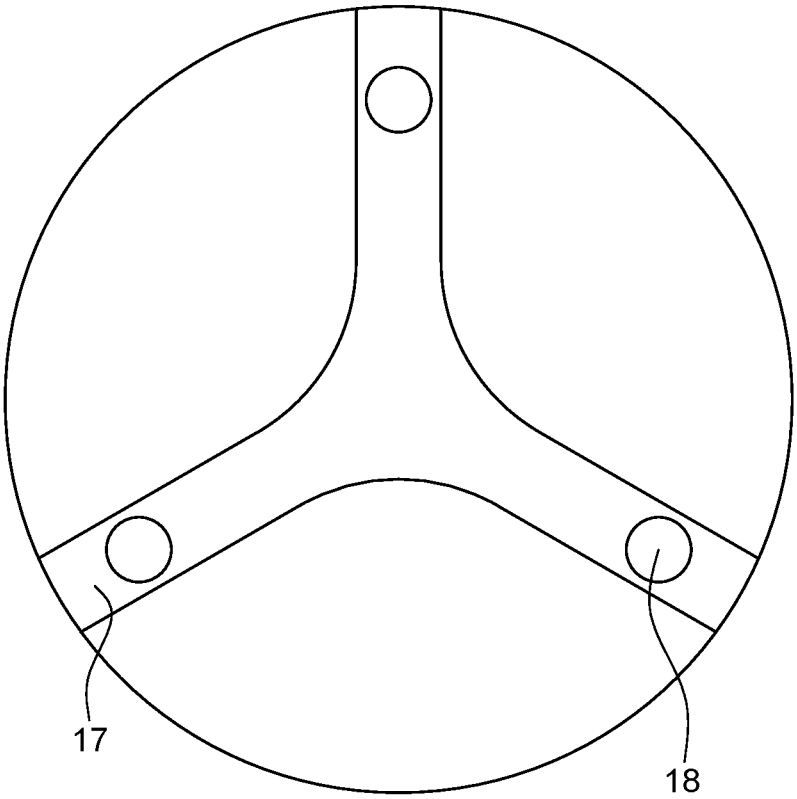
Figure 1D:
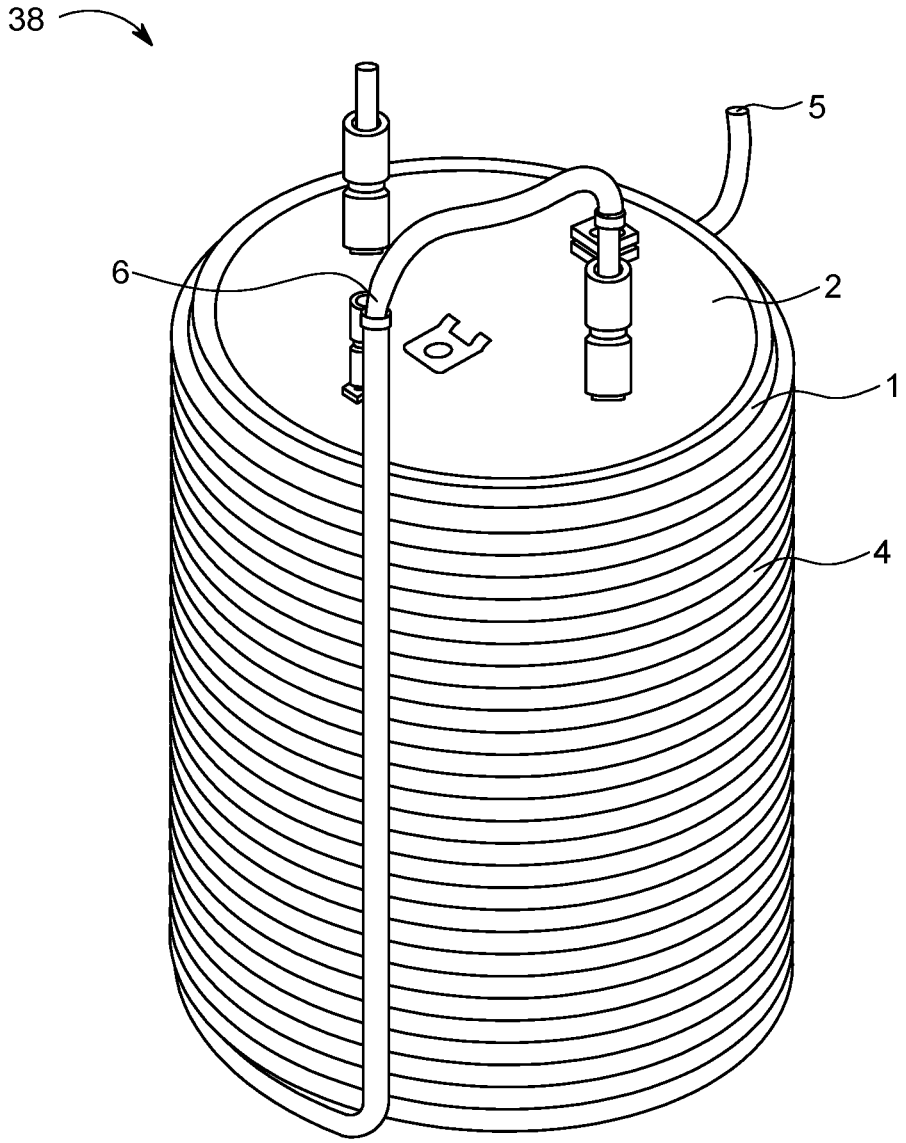
Figure 2:
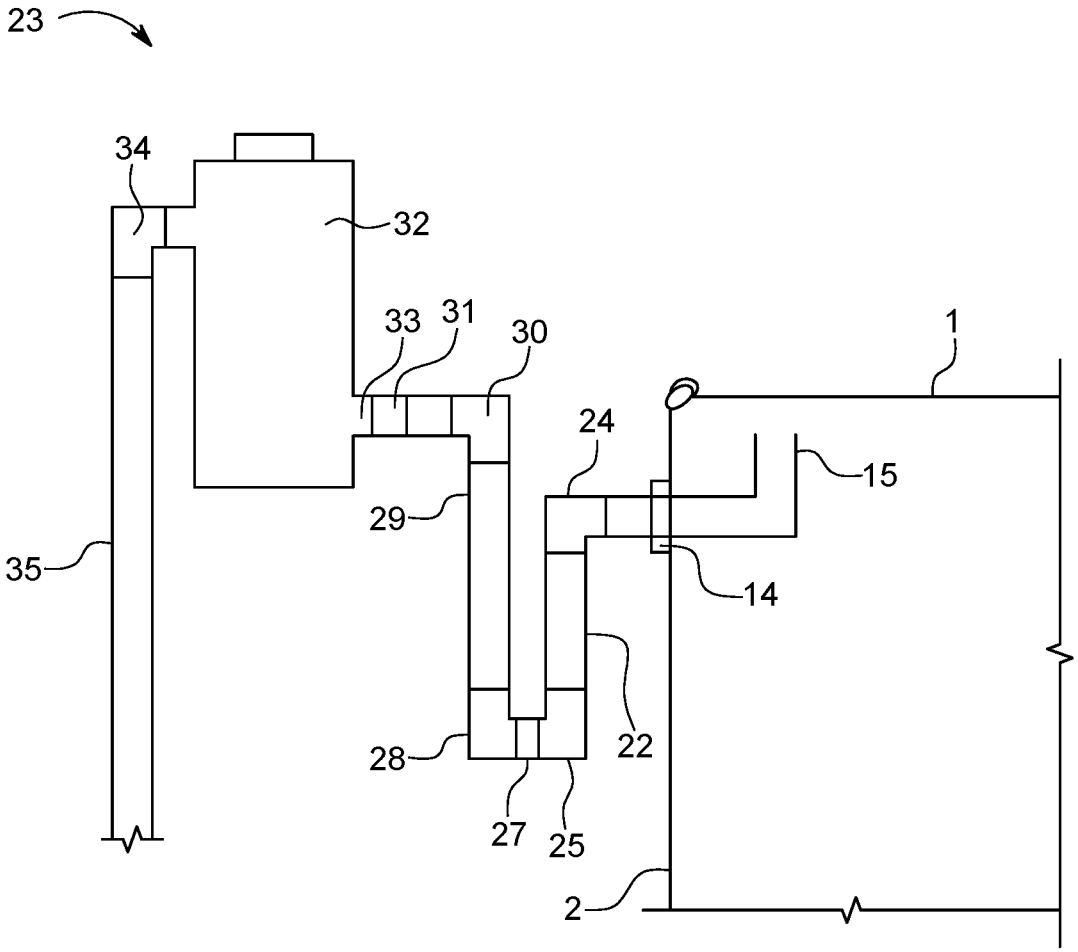
Figure 3:
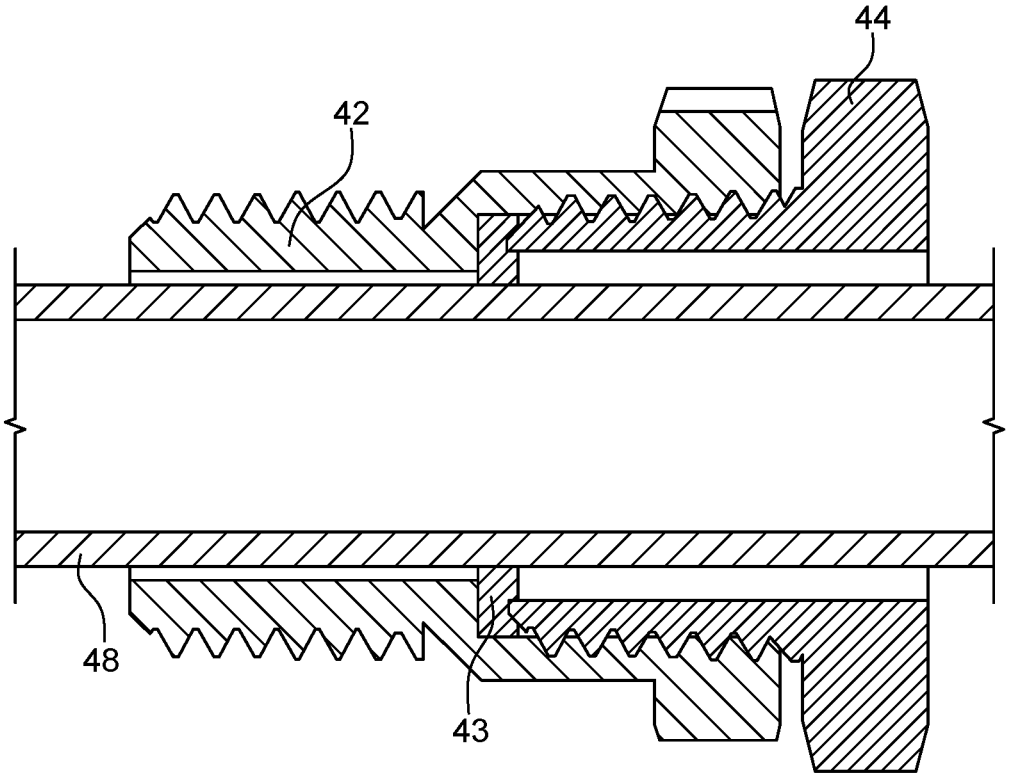
Figure 4:
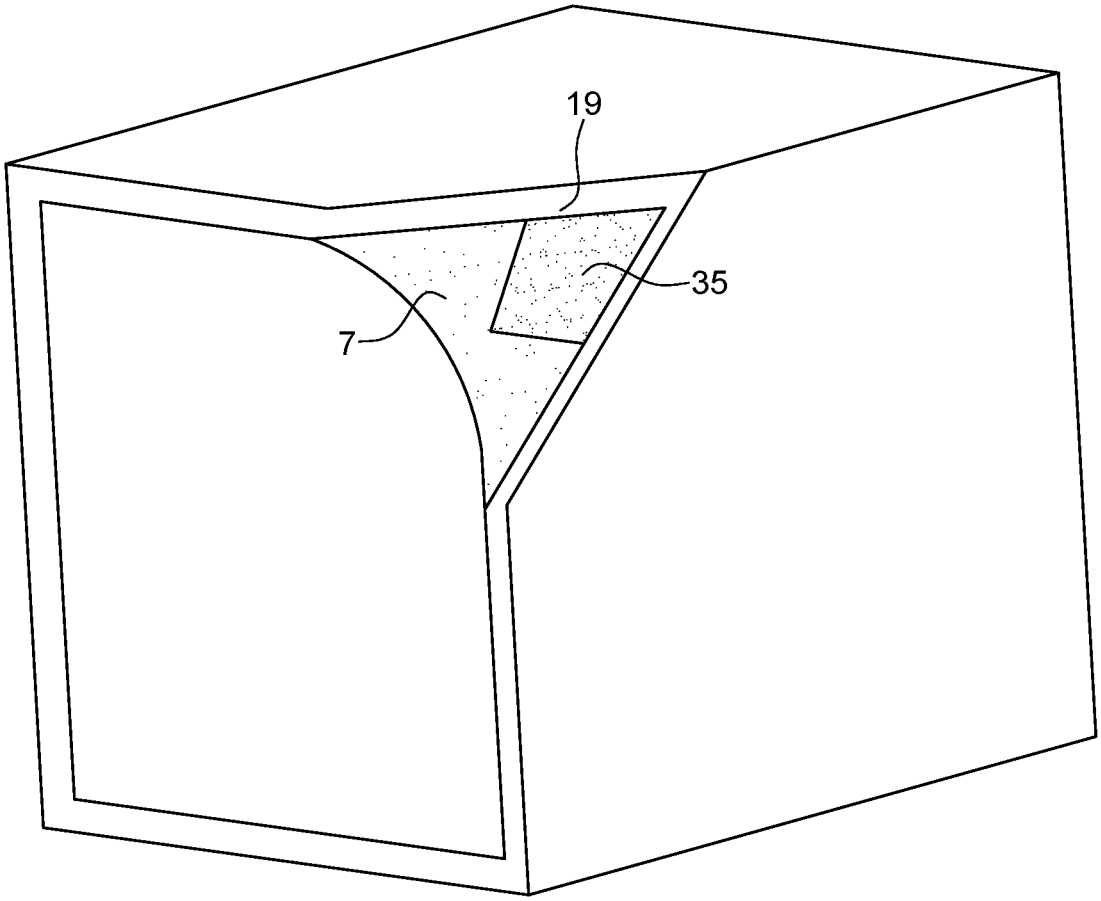
Figure 4A:
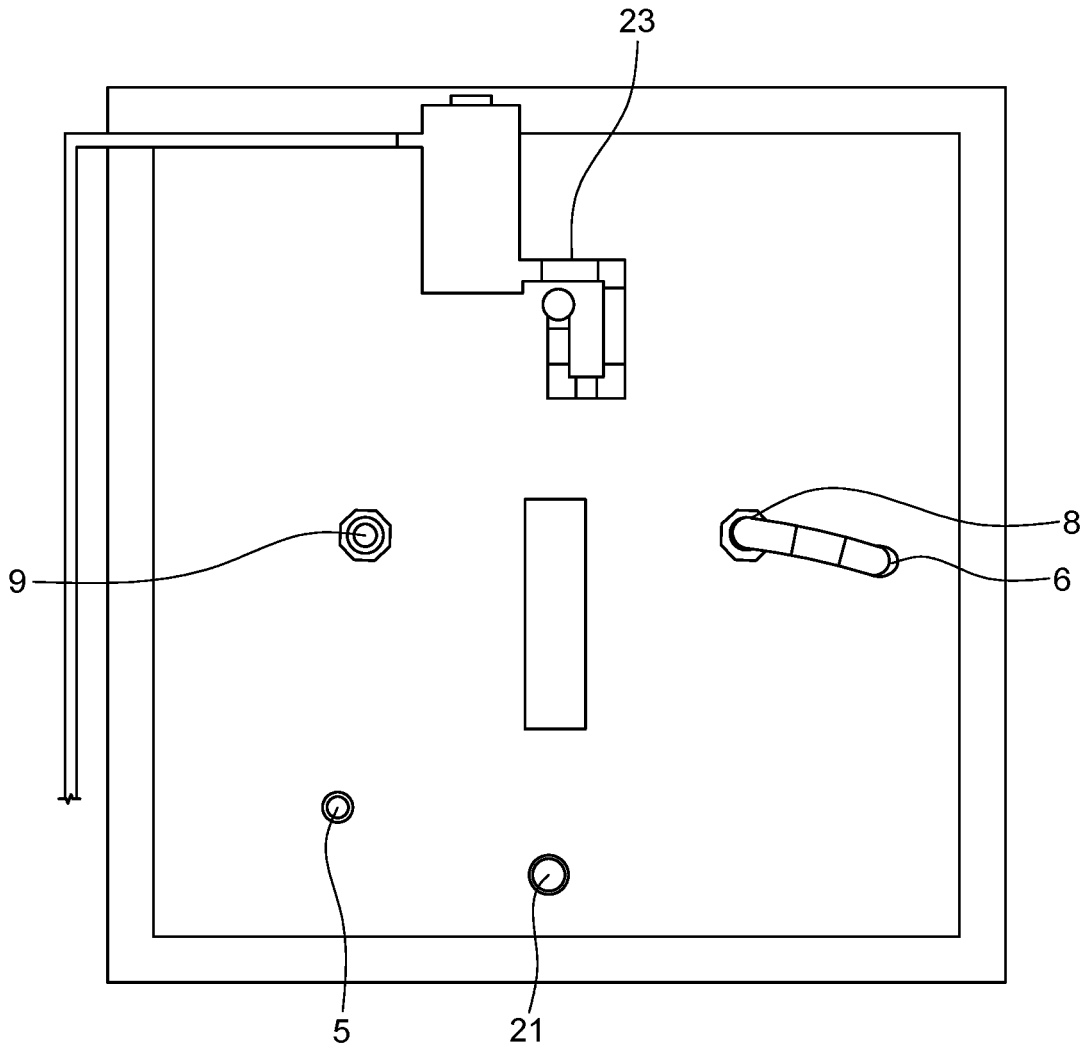
Figure 4B:
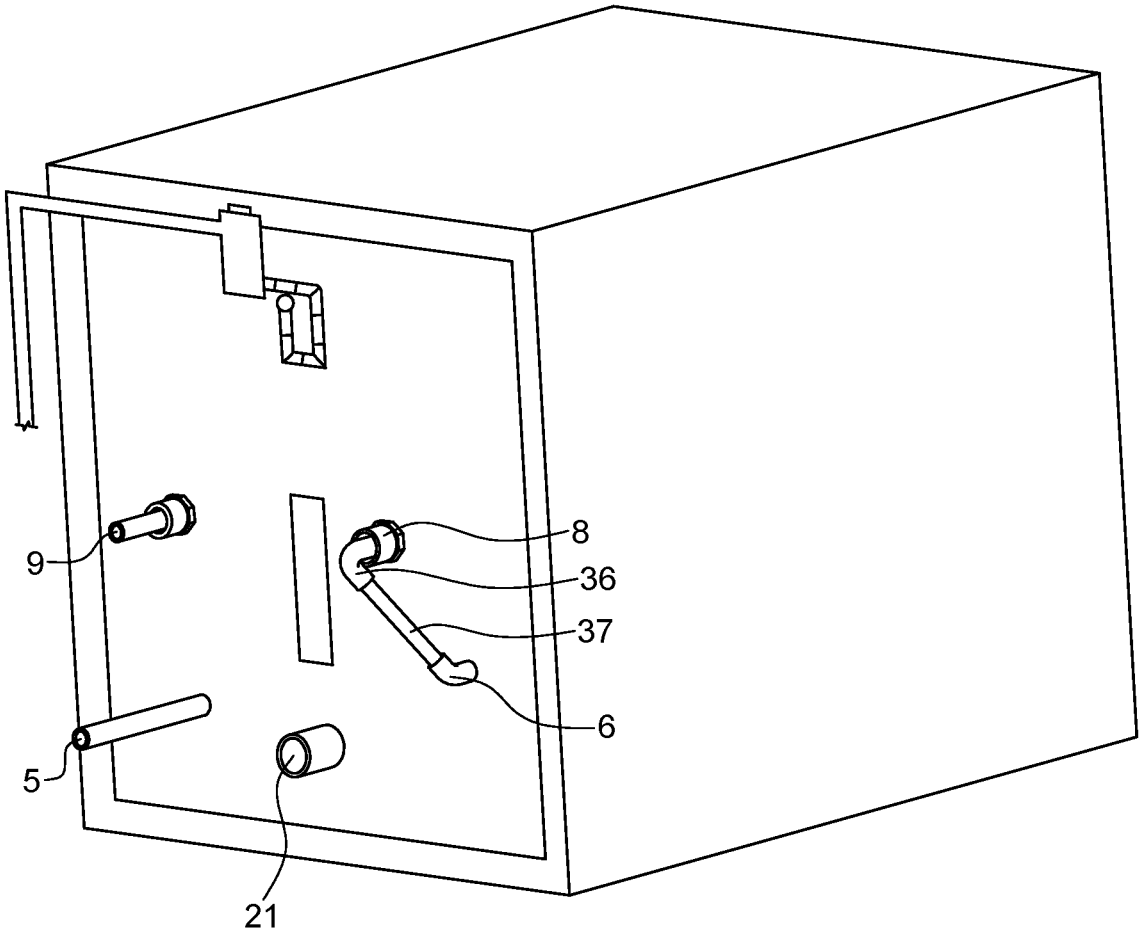
Figure 5:
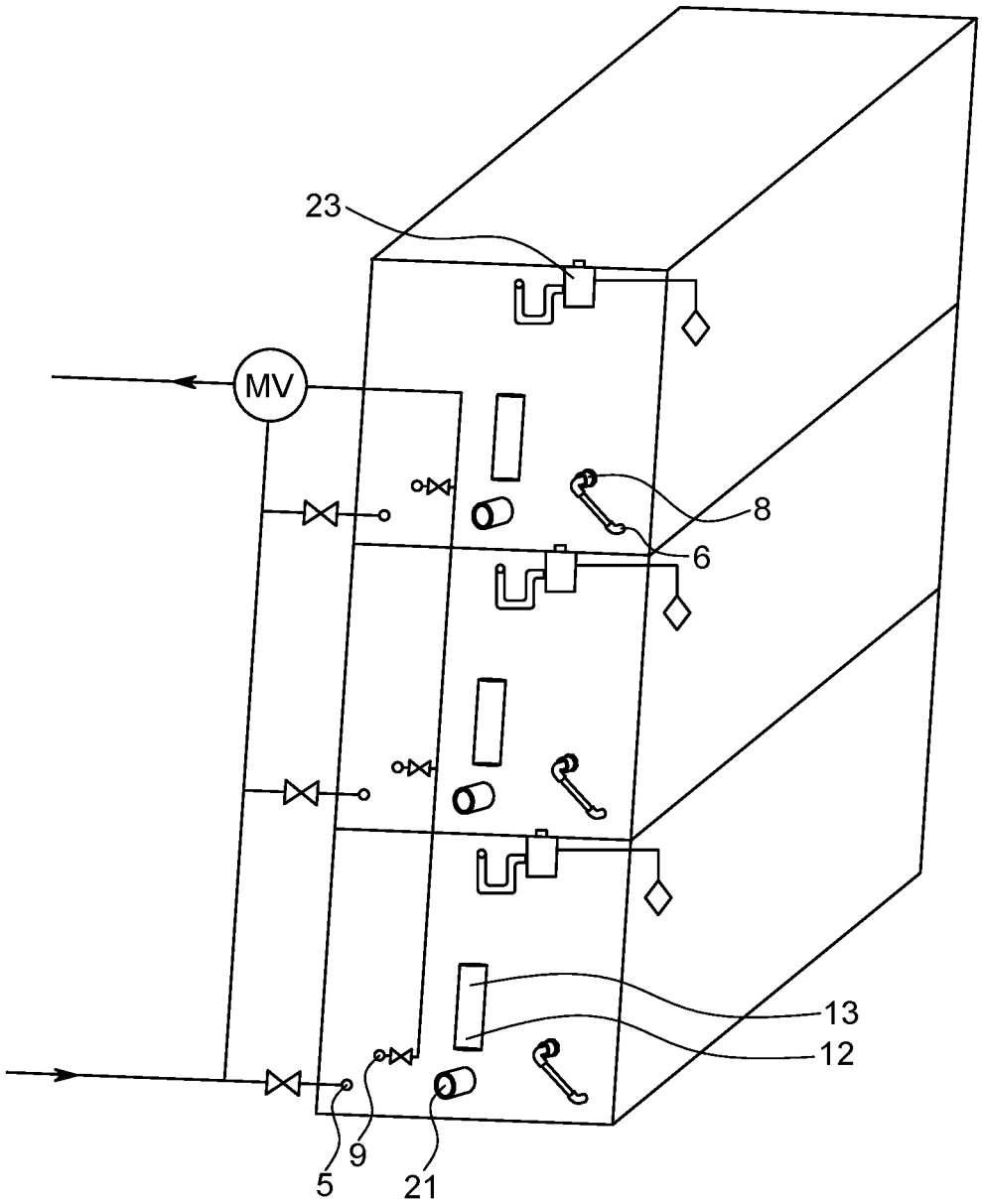
Figure 6:
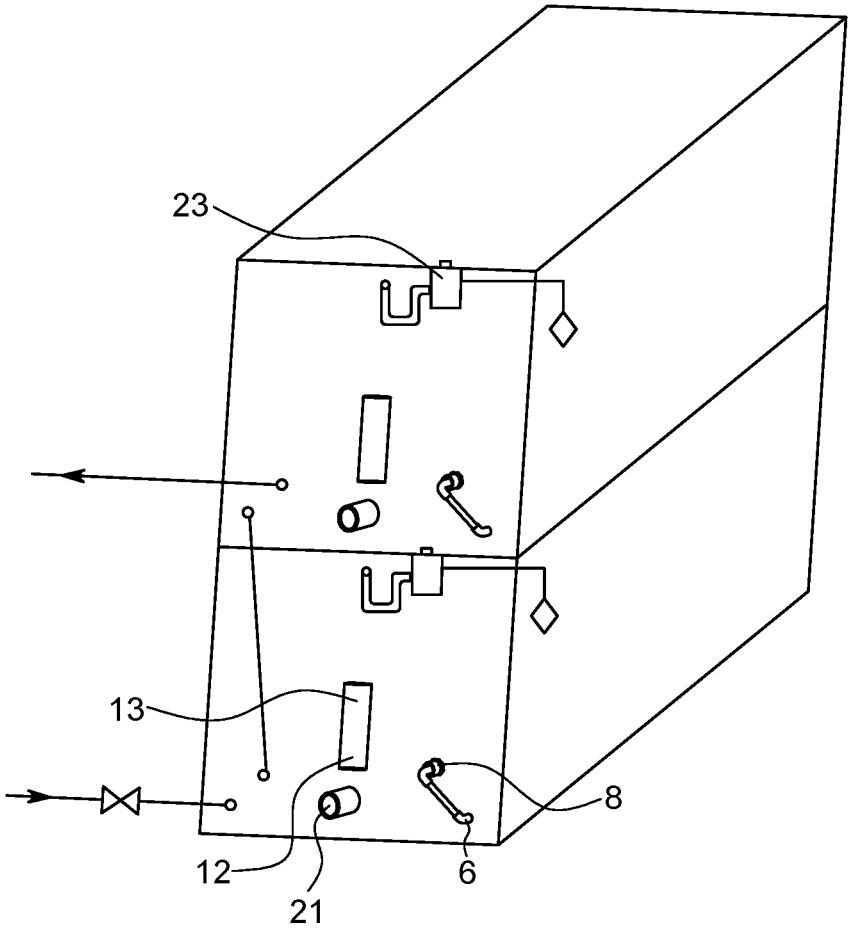

FIG. 1
Shows a cutaway of the complete invention.
FIG. 1A
Shows the open head assembly.
FIG. 1B
Shows a heat exchange coil assembly.
FIG. 1C
Shows the end view of the coil support, system.
FIG. 1D
Shows the regenerative pre-heat coil and vessel assembly.
FIG. 2
Shows cut away the temperature/pressure vent assembly installed.
FIG. 3
Shows the sealing glands detail (48) pressure pipe from coil, (42) male by female bushing, (43) rubber sealing, washer, (45) sealing, nut.
FIG. 4
Shows a cutaway of the insulation package.
FIG. 4A
Shows a front view of the completed invention.
FIG. 4B
Shows a front and side view of the completed invention.
FIG. 5
Plumbing—Stacked option.
FIG. 6
Plumbing—Staged option.

DETAILED DESCRIPTION

Although the invention is illustrated and described herein with reference to specific embodiments, the invention is not intended to be limited to the details shown, Rather various modifications may be made in the details within the scope and range of equivalents of the claims and without departing from the inventions.

A vessel assembly (38) (FIG. 1D) comprising a 30-gallon open head drum (1) that forms the open head drum assembly (38) (FIG. 1D) with a open head closure assembly (39) (FIG. 1A) on one end and containing a heat exchange coil assembly (40) (FIG. 1B) with a ring seal (3).

The open head drum (1) wound in piping such as but not limited to Pex-Al-Pex (4) from open end (6) to closed end of the open head drum (1). The pipe coil extended back to the open end to serve as the initial cold-water inlet (5) and extends beyond the limits of the insulation to act as the regenerated preheated water supply. The piping (6) that ends at the open end of the open head drum (1) awaits closure of the open head drum and attachment to heat exchange coil assembly (8).

(1) The open head drum assembly (38) (FIG. 1D) wrapped in radiant insulation shell (7), set aside for final vessel assembly.

The open head closure assembly (39) prepared by boring three holes (45, 46, 47) (FIG. 1A) into the open head closure (2) to accommodate the bulkhead fittings for the attachment of the preheated cold inlet (8) and hot outlet (9) with sealing glands (10) (FIG. 3) and a sacrificial anode rod (11).

A hole is bored for a heating element (12) and four holes bored for bolting the heating element (12), a thermostatic control device (13), and brackets to the open head closure (2). A reducing bushing (14) with the internal vent (15) attached, installed in the internal vent (15) that is located at the upper most portion of the open head closure assembly (39) (FIG. 1A), set aside for final vessel assembly.

Heat Exchange Coil assembly (40) (FIG. 1B) comprising of: two concentric heat exchange coils (16) formed of pipe, (possibly but not limited to copper), in series, matching discharge of hot water side. The preheated cold inlet (8) and hot outlet (9) heat exchanger coil pipes are extended beyond the vessel walls via bulkhead fittings and the sealing glands (10).

The heat exchange coil (16) supported by two triangle pieces (17) and three rods (18) inserted into the heat exchange coils (16). The complete vessel assembly (41) (FIG. 1) consists of the heat exchange coil assembly (40) (FIG. 1B) being inserted into the open head drum assembly (38) (FIG. 1D), the open head closure assembly (39) (FIG. 1A) attached to the ring seal (3) and the sealing glands (10) tightened, the heating element (12) inserted, and the thermostatic control device (13) attached and wired constitutes the vessel assembly (38) (FIG. 1D).

The vessel assembly (38) (FIG. 1D) insulated in a rectangular container with insulating board (19) and two stub pipes (20), one affixed to a lower bung tapping for the drain/fill valve (21), the other stub pipe (22) affixed to a bushing (14) for attachment to the pressure temperature vent assembly (23) (FIG. 2) once the insulating cover is sealed. The preheat discharge (6) connected to the cold water inlet (8) of the heat exchange coil assembly (40) by means of two 90 degree push connectors (36) and a short pipe (37) (FIG. 4B).

The pressure-temperature vent assembly (FIG. 2) comprising of a 90 degree elbow (24) attached to a stub pipe (22) in a down direction. A pipe attached (25) to a 90 degree elbow (26) set horizontal, a pipe (27) attached a 90 degree elbow (28) in the vertical upright position. A pipe attached (29) attached to a 90-degree elbow (30) in a horizontal position; a pipe and a male adapter (31) attached to the lower port of the reservoir (32) affixed by a the male adapter (33). The bottom of the reservoir must be in line with the highest level in the tank, a 90 degree elbow (34) affixed to the top outlet of a reservoir (32), a discharge pipe (35).

The invention claimed is:

1. A water heating device comprising;
an open head cylindrical vessel;
a closure head at the open end of the vessel;
a heat exchanger surrounding the vessel;
at least one heat exchange assembly internal to the vessel: said heat exchange assembly being in coil form;
a vent that communicates with the atmosphere;
a heating element; a thermostatic control device;
a radiant barrier shell acting as an outer wall of the device such that cylindrical vessel, the closure head, the heat exchanger and the internal heat exchange assembly are surrounded by the radiant barrier shell.

2. The device of claim 1 wherein the radiant barrier shell comprises a rectangular box form.

3. The device of claim 1, wherein the closure head further comprises:

a sealing gland system for a water intake and a water outlet;

a sacrificial anode;

a sacrificial anode;

a valve that can be used to drain or fill the open head cylindrical vessel: and a thermostatic control device.

4. The apparatus of claim 3, wherein the closure head further comprises: Seven holes for attaching four bulkhead fittings to receive the two sealing glands, The sacrificial anode, and the heating element.

5. The device of claim 1 further comprising: a support system for at least one heat exchange assembly, said support system comprising two triangles with a leg; the legs rest upon an inner vessel wall with at least one support rod between the triangles to provide support to at least one heat exchange assembly.

6. The device of claim 1, wherein the vent further comprises;

A vent stub pipe fitted with a pressure-temperature-vent assembly comprising of a heat trap loop and a reservoir for direct communication with the atmosphere.

* * * * *